US007348928B2

(12) United States Patent
Ma et al.

(10) Patent No.: US 7,348,928 B2
(45) Date of Patent: Mar. 25, 2008

(54) SLOT ANTENNA HAVING A MEMS VARACTOR FOR RESONANCE FREQUENCY TUNING

(75) Inventors: Qing Ma, San Jose, CA (US); Xintian Eddie Lin, Mountain View, CA (US); Al Bettner, Los Gatos, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 11/013,594

(22) Filed: Dec. 14, 2004

(65) Prior Publication Data

US 2006/0125703 A1 Jun. 15, 2006

(51) Int. Cl.
*H01Q 13/10* (2006.01)

(52) U.S. Cl. ..... 343/770; 343/767; 343/768

(58) Field of Classification Search ..... 343/768, 343/770

See application file for complete search history.

(56) References Cited

U.S. PATENT DOCUMENTS

| | | | | |
|---|---|---|---|---|
| 3,328,800 | A * | 6/1967 | Algeo | 343/768 |
| 5,644,319 | A * | 7/1997 | Chen et al. | 343/702 |
| 6,028,561 | A * | 2/2000 | Takei | 343/767 |
| 6,355,534 | B1 | 3/2002 | Cheng et al. | |
| 6,593,672 | B2 | 7/2003 | Ma et al. | |
| 6,756,857 | B2 * | 6/2004 | Aikawa et al. | 331/177 V |
| 6,864,848 | B2 * | 3/2005 | Sievenpiper | 343/767 |
| 2003/0062963 | A1 * | 4/2003 | Aikawa et al. | 331/177 V |
| 2006/0079177 | A1 * | 4/2006 | Okubora | 455/25 |

FOREIGN PATENT DOCUMENTS

| | | | |
|---|---|---|---|
| GB | 2304464 | A | 3/1997 |
| WO | WO 03/094293 | A | 11/2003 |

OTHER PUBLICATIONS

Wikipedia, Indicator, http://en.wikipedia.org/wiki/Inductor.*

(Continued)

*Primary Examiner*—Don Wong
*Assistant Examiner*—Angela M Lie
(74) *Attorney, Agent, or Firm*—Kevin A. Reif

(57) ABSTRACT

Briefly, in accordance with one embodiment of the invention, a slot antenna may include a primary slot and one or more secondary slots. The size of the antenna may be reduced by adding one or more of the secondary slots which may add additional inductance to the antenna. Furthermore, the size of the antenna may be reduced by increasing the inductance of the secondary slots via increasing the length of the slots or by changing the shape of the slots. The antenna may include one or more MEMS varactors coupled to one or more of the secondary slots. The resonant frequency of the slot antenna may be tuned to a desired frequency by changing the capacitance value of one or more of the MEMS varactors to a desired capacitance value.

20 Claims, 4 Drawing Sheets

OTHER PUBLICATIONS

Carrasquillo-Rivera H et al.: "Tunable and dual-band rectangular slot-ring antenna"; IEEE Antennas and Propagation Society Symposium,; Jun. 20, 2004; pp. 308-4311; vol. 4; XP010722481.

Behdad N et al: "Bandwidth Enhancement and Futther Size Reduction of a Class of Miniaturized Slot Antennas"; IEEE Transactions on Antennas and Propagation,; vol. 52, No. 8, Aug. 2004; pp. 1928-1935, XP001200688.

Carrasquillo-Rivera H et al.: "Tunable slot antenna using varactors and photodiodes" IEEE Antennas and Propagation Society Symposium. 2003 Digest.; Jun. 22, 2003, vol. 4 of 4, pp. 532-535, XP010650852.

PCT Internation Search Report and Written Opinion of the ISA; Application No. PCT/US2005/044776; Filing Date: Dec. 9, 2005.

* cited by examiner

FIG. 4A
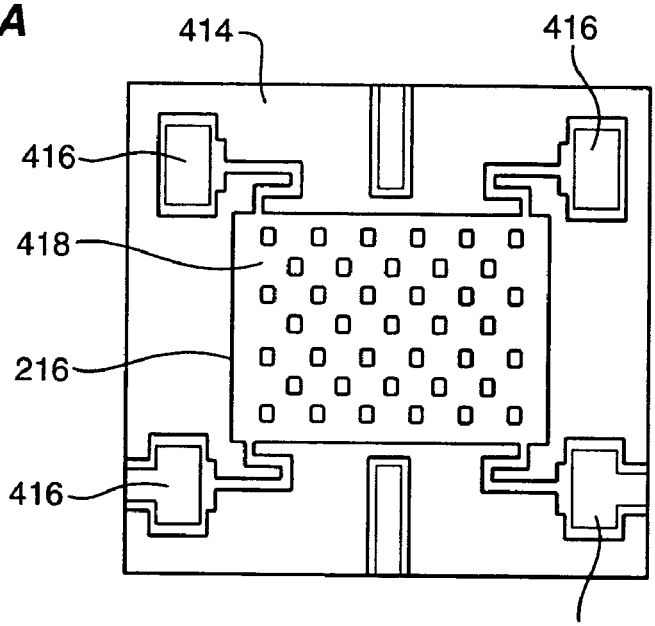
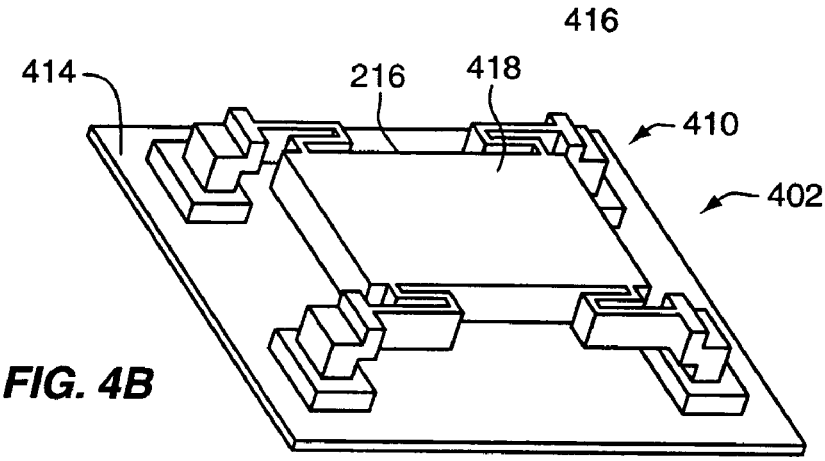
FIG. 4B
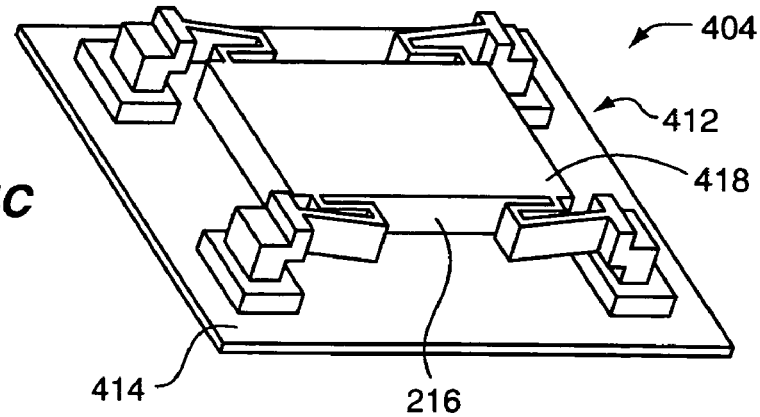
FIG. 4C

SLOT ANTENNA HAVING A MEMS VARACTOR FOR RESONANCE FREQUENCY TUNING

BACKGROUND OF THE INVENTION

Miniaturized antennas are effective for utilization in mobile wireless communication applications, particularly for handheld devices such as cell phones and personal digital assistants that may incorporate a radio-frequency communication system. Miniaturized slot antennas have been described and designed. When the size of an antenna size is reduced, its bandwidth is also reduced accordingly. As a result, miniaturized antennas having a size suitable for handheld devices may have a bandwidth that is too narrow to cover the pass band of a communication standard that is desired for the handheld devices to utilize.

DESCRIPTION OF THE DRAWING FIGURES

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 5:
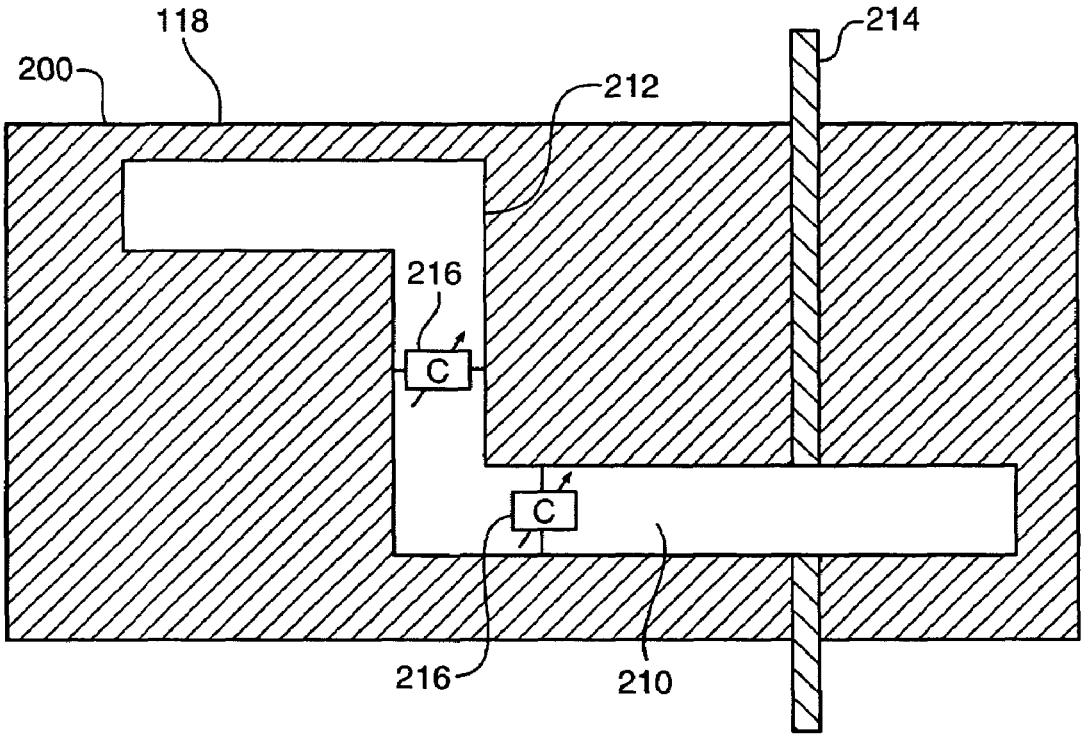

FIGS. 4A, 4B, and 4C are schematic diagrams of a MEMS varactor suitable for utilization in a slot antenna in accordance with one or more embodiments of the present invention; and FIG. 5 is a schematic diagram of a general case slot antenna having a MEMS varactor in accordance with one or more embodiments of the present invention.

It will be appreciated that for simplicity and clarity of illustration, elements illustrated in the figures have not necessarily been drawn to scale. For example, the dimensions of some of the elements are exaggerated relative to other elements for clarity. Further, where considered appropriate, reference numerals have been repeated among the figures to indicate corresponding or analogous elements.

DETAILED DESCRIPTION

In the following detailed description, numerous specific details are set forth in order to provide a thorough understanding of the invention. However, it will be understood by those skilled in the art that the present invention may be practiced without these specific details. In other instances, well-known methods, procedures, components and circuits have not been described in detail so as not to obscure the present invention.

In the following description and claims, the terms coupled and connected, along with their derivatives, may be used. In particular embodiments, connected may be used to indicate that two or more elements are in direct physical or electrical contact with each other. Coupled may mean that two or more elements are in direct physical or electrical contact. However, coupled may also mean that two or more elements may not be in direct contact with each other, but yet may still cooperate or interact with each other.

It should be understood that embodiments of the present invention may be used in a variety of applications. Although the present invention is not limited in this respect, the circuits disclosed herein may be used in many apparatuses such as in the transmitters and receivers of a radio system. Radio systems intended to be included within the scope of the present invention include, by way of example only, wireless local area networks (WLAN) devices and wireless wide area network (WWAN) devices including wireless network interface devices and network interface cards (NICs), base stations, access points (APs), gateways, bridges, hubs, cellular radiotelephone communication systems, satellite communication systems, two-way radio communication systems, one-way pagers, two-way pagers, personal communication systems (PCS), personal computers (PCs), personal digital assistants (PDAs), and the like, although the scope of the invention is not limited in this respect.

Types of wireless communication systems intended to be within the scope of the present invention include, although not limited to, Wireless Local Area Network (WLAN), Wireless Wide Area Network (WWAN), Code Division Multiple Access (CDMA) cellular radiotelephone communication systems, Global System for Mobile Communications (GSM) cellular radiotelephone systems, North American Digital Cellular (NADC) cellular radiotelephone systems, Time Division Multiple Access (TDMA) systems, Extended-TDMA (E-TDMA) cellular radiotelephone systems, Third Generation Partnership Project (3GPP or 3G) systems like Wide-band CDMA (WCDMA), CDMA-2000, and the like, although the scope of the invention is not limited in this respect.

Figure 1:
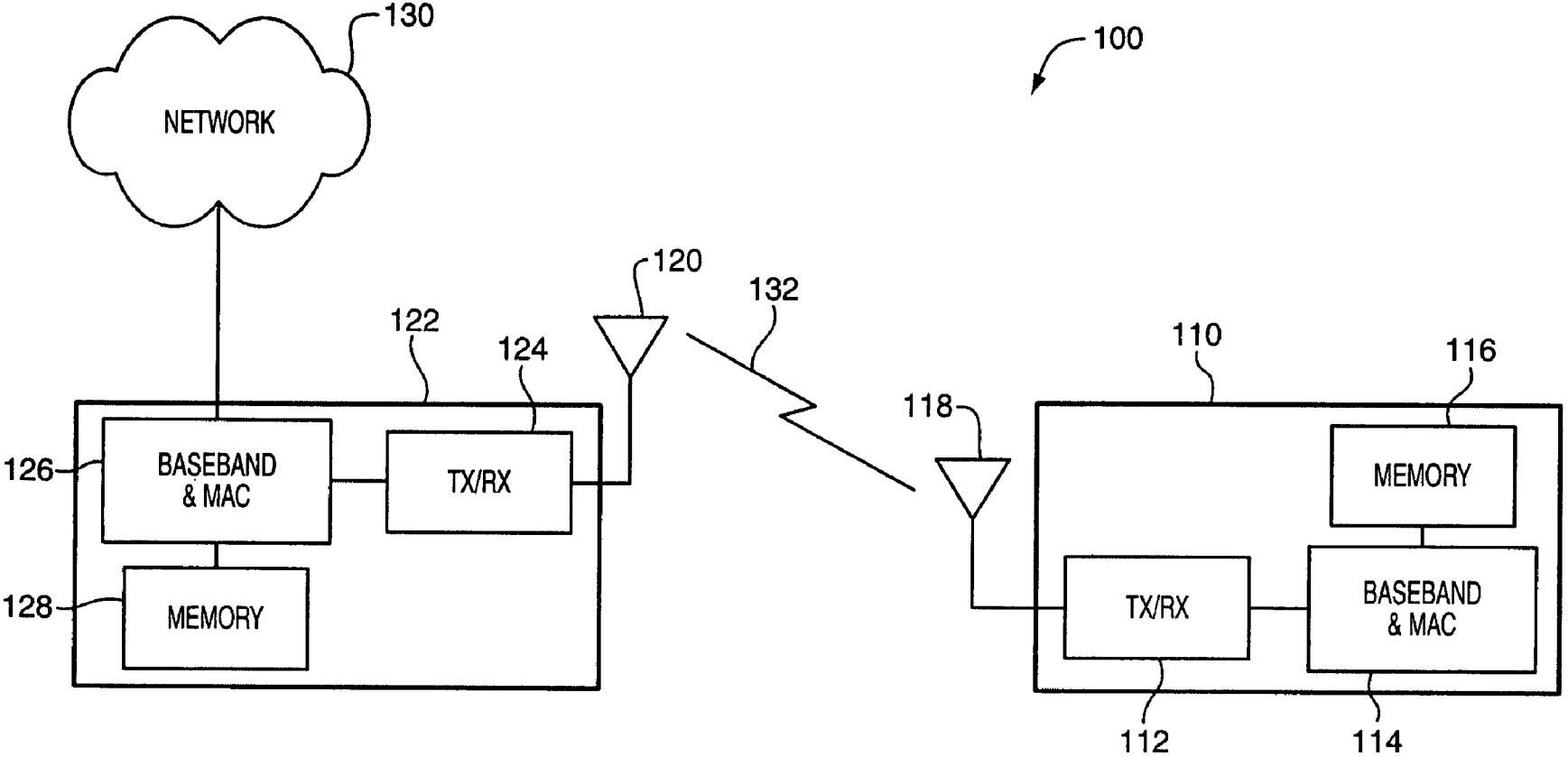
FIG. 1 is a block diagram of a wireless local area or cellular network communication system in accordance with one or more embodiments of the present invention.

Referring now to FIG. 1, a block diagram of a wireless local area or cellular network communication system in accordance with one or more embodiments of the present invention will be discussed. In the communication system 100 shown in FIG. 1, a mobile unit 110 may include a wireless transceiver 112 to couple to an antenna 118 and to a processor 114 to provide baseband and media access control (MAC) processing functions. In accordance with one or more embodiments of the present invention, antenna 118 may be a slot antenna having a MEMS varactor for resonant frequency tuning of the antenna as show in and described with respect to FIGS. 2, 3, and 4, although the scope of the invention is not limited in this respect. In one embodiment of the invention, mobile unit 110 may be a cellular telephone or an information handling system such as a mobile personal computer or a personal digital assistant or the like that incorporates a cellular telephone communication module, although the scope of the invention is not limited in this respect. Processor 114 in one embodiment may comprise a single processor, or alternatively may comprise a baseband processor and an applications processor, although the scope of the invention is not limited in this respect. Processor 114 may couple to a memory 116 which may include volatile memory such as dynamic random-access memory (DRAM), non-volatile memory such as flash memory, or alternatively may include other types of storage such as a hard disk drive, although the scope of the invention is not limited in this respect. Some portion or all of memory 116 may be included on the same integrated circuit as processor 114, or alternatively some portion or all of memory 116 may be disposed on an integrated circuit or other medium, for example a hard disk drive, that is external to the integrated circuit of processor 114, although the scope of the invention is not limited in this respect.

Mobile unit 110 may communicate with access point 122 via wireless communication link 132, where access point 122 may include at least one antenna 120, transceiver 124, processor 126, and memory 128. In one embodiment, access point 122 may be a base station of a cellular telephone network, and in an alternative embodiment, access point 122 may be a an access point or wireless router of a wireless local or personal area network, although the scope of the invention is not limited in this respect. In an alternative embodiment, access point 122 and optionally mobile unit 110 may include two or more antennas, for example to provide a spatial division multiple access (SDMA) system or a multiple input, multiple output (MIMO) system, although the scope of the invention is not limited in this respect. Access point 122 may couple with network 130 so that mobile unit 110 may communicate with network 130, including devices coupled to network 130, by communicating with access point 122 via wireless communication link 132. Network 130 may include a public network such as a telephone network or the Internet, or alternatively network 130 may include a private network such as an intranet, or a combination of a public and a private network, although the scope of the invention is not limited in this respect. Communication between mobile unit 110 and access point 122 may be implemented via a wireless local area network (WLAN), for example a network compliant with a an Institute of Electrical and Electronics Engineers (IEEE) standard such as IEEE 802.11a, IEEE 802.11b, HiperLAN-II, and so on, although the scope of the invention is not limited in this respect. In another embodiment, communication between mobile unit 110 and access point 122 may be at least partially implemented via a cellular communication network compliant with a Third Generation Partnership Project (3GPP or 3G) standard, although the scope of the invention is not limited in this respect. In one or more embodiments of the invention, antenna 118 may be utilized in a wireless sensor network or a mesh network, although the scope of the invention is not limited in this respect.

Figure 2:
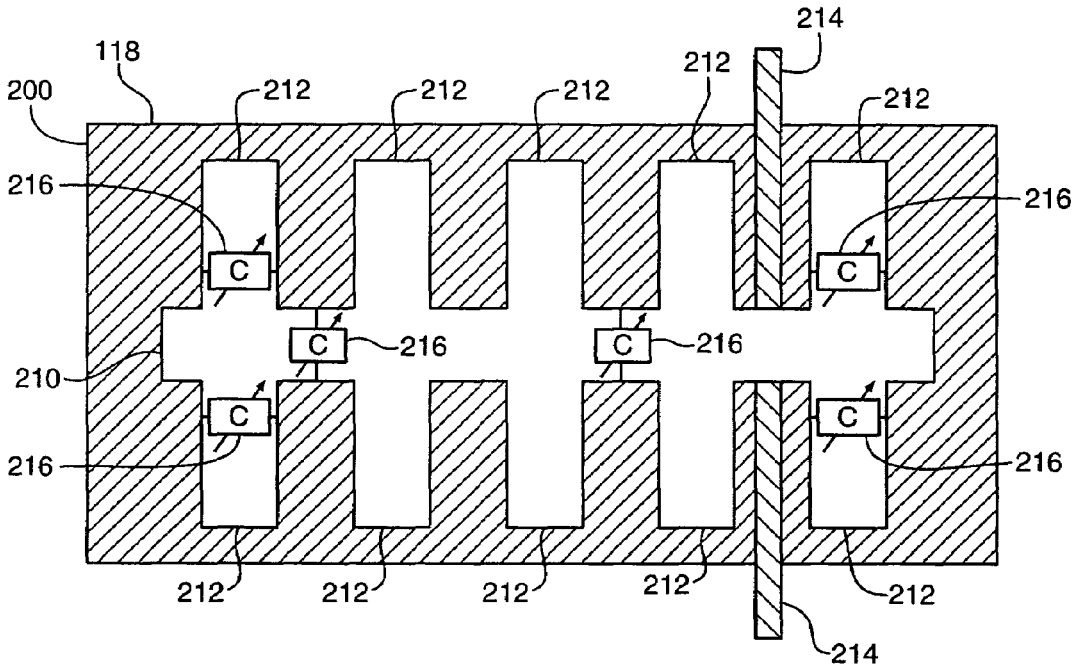
FIG. 2 is a schematic diagram of a slot antenna having a MEMS varactor for resonance frequency tuning in accordance with one or more embodiments of the present invention.

Referring now to FIG. 2, a schematic diagram of a slot antenna having a MEMS varactor for resonance frequency tuning in accordance with one or more embodiments of the present invention will be discussed. Antenna 118 may be a slot antenna that may be constructed from a planar layer 200 which may be a conductive material such as a metal. Planar layer 200 may generally lie within a plane, but may also alternatively be arranged into other non-planar forms and shapes, and the scope of the invention is not limited in this respect. Planar layer 200 may be referred to generally as an antenna layer, although the scope of the invention is not limited in this respect. Planar layer 200 may have a primary slot 210 and one or more secondary slots 212 formed thereon. Primary slot 210 and secondary slots 212 may function as radiators having dimensions selected to provide a half wavelength antenna to operate as a dipole antenna. When energy is applied to antenna 118, current may flow through planar layer 200 and electric field lines may be produced at primary slot 210 and/or secondary slots 212 to radiate or receive radio-frequency energy. By adding one or more secondary slots 212 to primary slot 210, the inductance of antenna 118 may be increased. In one embodiment of the invention, the size of antenna 118 may be decreased by the addition of a greater number of secondary slots 212. In addition, the size of antenna 118 may be further decreased by increasing the inductance of secondary slots 212, for example by increasing the length of secondary slots 212 or by the selected shape of secondary slots 212, for example by providing a folded or coiled shape to secondary slots 212. An example of an antenna having an alternatively shaped secondary slot is shown in and described with respect to FIG. 3. A microstrip feed 214 may couple antenna 118 to a radio-frequency circuit such as transceiver 112, although the scope of the invention is not limited in this respect.

By constructing a smaller sized antenna 118, the antenna 118 may be selectively tuned by utilization of one or more varactors 216 to couple to one or more secondary slots 212. In one embodiment of the invention, one of secondary slots 212 may include a varactor 212, in an alternative embodiment of the invention two or more of secondary slots 212 may include one or more varactors 216, and in yet another alternative embodiment all or most of secondary slots 212 may include one or more varactors 216, although the scope of the invention is not limited in this respect. Furthermore, in one or more alternative embodiments, one or more varactors 216 may be optionally included in primary slot 210 either in lieu of varactors 216 in secondary slots 212, or alternatively in combination with one or more varactors 216 in secondary slots 212, although the scope of the invention is not limited in this respect. A varactor 216 may generally be referred to as a variable capacitor having a varying or selectable capacitance. In one embodiment of the invention, varactor 216 may be a microelectromechanical system (MEMS) based varactor such as shown in and described with respect to FIG. 4, and in another embodiment of the invention varactor 216 may include a varactor diode, although the scope of the invention is not limited in this respect. A capacitance value may be applied to one or more of secondary slots 212 to reduced the inductance of one or more secondary slots 212 and to reduce the inductance of antenna 118 at one or more desired frequencies. The capacitance of one or more varactors 216 in combination with the inductance of one or more secondary slots 212 or the inductance of antenna 118 may provide a resonant circuit that may be utilized to selectively tune the resonant frequency of antenna 118 via selective actuating one or more of varactors 216 or via selectively setting the capacitance value of one or more varactors 216 to a capacitance that may cause a resonant frequency of antenna 118 to be tuned to a desired frequency of operation of antenna 118. For example, when the selected capacitance is increased in value, the inductance of antenna 118 may be reduced, and the resonant frequency of antenna 118 may be increased to a desired frequency of operation, although the scope of the invention is not limited in this respect.

In one embodiment of the invention, a pass band for a cellular communication system such a communication system 100 as shown in and described with respect to FIG. 1 may be divided into one or more channels, for example where the channels may have a bandwidth one the order of a few kilohertz. The resonance of antenna 118 may be tuned via varactors 216 to a desired channel wherein antenna 118 may have a resonant frequency that is tuned to the desired channel. Where varactor 216 is a MEMS varactor, the Q factor of varactor 216 may be relatively high, and the loss of antenna 118 may be relatively low, resulting in a narrow band mode of operation for antenna 118 to provide a relatively higher noise rejection characteristic, although the scope of the invention is not limited in this respect. When it is desired to operate on another channel, the resonant frequency of antenna 118 may be selected via changing the capacitance of varactor 216 to tune antenna 118 to the other channel, although the scope of the invention is not limited in this respect.

Figure 3:
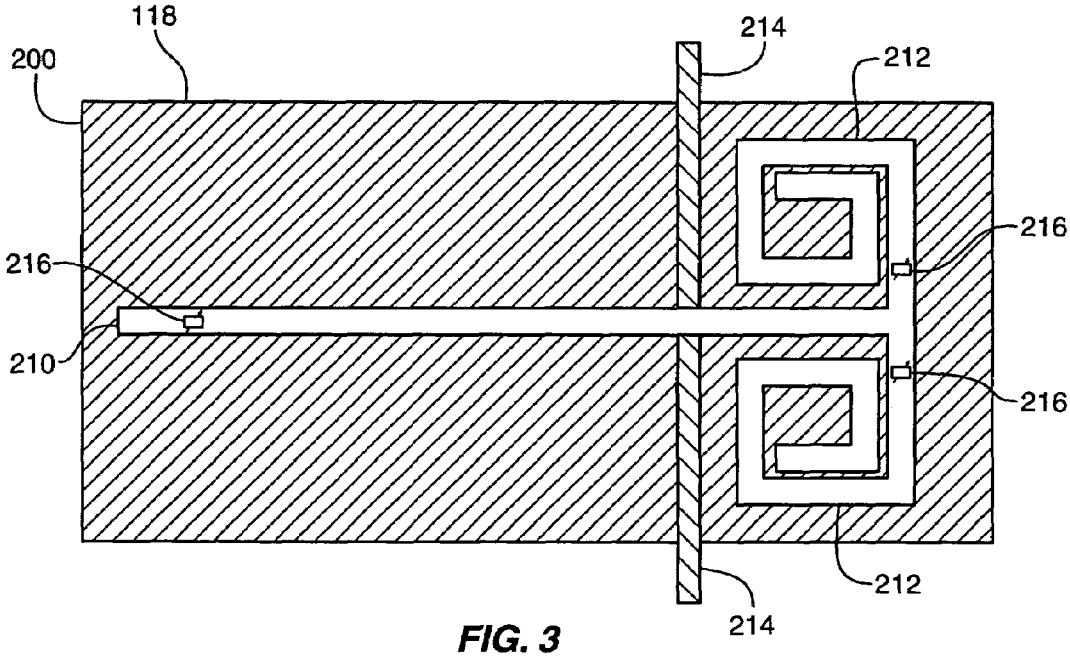
FIG. 3 is a schematic diagram of an alternative slot antenna having a MEMS varactor in accordance with one or more embodiments of the present invention.

Referring now to FIG. 3, a schematic diagram of an alternative slot antenna having a MEMS varactor in accordance with one or more embodiments of the present invention will be discussed. As shown in FIG. 3, secondary slots 216 may be constructed to have a longer length than secondary slots 212 as shown in FIG. 2. In such a configuration, there may be a greater inductance per secondary slot 212 which may allow for a greater reduction in the size of antenna 118. In one particular embodiment of the invention, secondary slots 212 may be further arranged in a coil shape to provide an increased inductance per secondary slot 212, which may be for example a result of an increased self inductance for the secondary slots 212 provided by the coiled or folded structure of secondary slot 212. As discussed with respect to FIG. 2, one or more varactors 216 may be coupled to one or more secondary slots 212 to selectively tune the resonant frequency of antenna 118 to a desired frequency or channel. Furthermore, in one or more alternative embodiments, one or more varactors 216 may be optionally included in primary slot 210 either in lieu of varactors 216 in secondary slots 212, or alternatively in combination with one or more varactors 216 in secondary slots 212, although the scope of the invention is not limited in this respect.

Referring now to FIGS. 4A, 4B, and 4C, schematic diagrams of a MEMS varactor suitable for utilization in a slot antenna in accordance with one or more embodiments of the present invention will be discussed. As shown in FIGS. 4A, 4B, and 4C, varactor 216 may be constructed as a MEMS structure to provide a controllable or selectable capacitance via actuation of varactor 216. A top plan view of varactor 216 is shown at 400, an isometric view of varactor 216 in a stand-by state 410 is shown at 402, and an isometric view of varactor 216 in an actuated state 412 is shown at 404. Varactor 216 may be a MEMS structure such as a plate 418 suspended above a plane 414 in a stand-by state 410. While in stand-by state 410, the capacitance value of varactor 216 may be a smaller value capacitance or effectively a zero value capacitance. When selected or actuated in actuation state 412, plate 418 may be deflected closer to plane 414 to provide a resulting capacitance value between plate 418 and plane 414. The closer that plate 418 is deflected toward plane 414, the greater the resulting capacitance value is provided by varactor 216, although the scope of the invention is not limited in this respect. One or more varactors 216 as shown in FIGS. 4A, 4B, and 4C may be coupled to provide a greater overall capacitance via selective actuation of one or more varactors 216, for example as shown and describe in U.S. Pat. No. 6,593,672, although the scope of the invention is not limited in this respect. Said U.S. Pat. No. 6,593,672 is hereby incorporated herein in its entirety. In one or more embodiments of the invention, one or more of varactors 216 may be a variable tuning range capacitor as shown and described in U.S. Pat. No. 6,355,534. Said U.S. Pat. No. 6,355,534 is hereby incorporated herein in its entirety. In one or more embodiments of the invention, a phase locked loop circuit (not shown) may be coupled to one or more of varactors 216 to set the capacitance value of one or more of varactors 216 to lock the resonant frequency of antenna 118 on a desired frequency of operation, although the scope of the invention is not limited in this respect.

Referring now to FIG. 5, a schematic diagram of a general case slot antenna having a MEMS varactor in accordance with one or more embodiments of the present invention will be discussed. A planar layer 200 of a general case antenna 118 may include a slot primary 210 of any arbitrary shape, and may also have one or more secondary slots 212 also having any arbitrary shape. A pass band for cellular communication, for example, may be divided into several channels, for example where each channel may have a bandwidth on the order of a few kilohertz. The resonant frequency of antenna 118 may be tuned to a desired channel in the pass band to cause an otherwise wider band antenna to operate as a narrow band antenna when tuned to the desired channel. One or more varactors 216 may be disposed in a slot 210 or 212 of antenna 118 and may provide frequency tuning of the resonant frequency of antenna 118 to the desired channel. In a general case, one or more of slots 210 and 212 may have an arbitrary shape. One or more of varactors 216 may be utilized to selectively reduce an effective inductance of the antenna. The resonant frequency of antenna 118 may be tuned by changing the capacitance of the varactors, although the scope of the invention is not limited in this respect.

Although the invention has been described with a certain degree of particularity, it should be recognized that elements thereof may be altered by persons skilled in the art without departing from the spirit and scope of the invention. It is believed that the slot antenna having a MEMS varactor for resonance frequency tuning of the present invention and many of its attendant advantages will be understood by the forgoing description, and it will be apparent that various changes may be made in the form, construction and arrangement of the components thereof without departing from the scope and spirit of the invention or without sacrificing all of its material advantages, the form herein before described being merely an explanatory embodiment thereof, and further without providing substantial change thereto. It is the intention of the claims to encompass and include such changes.

What is claimed is:

1. An apparatus, comprising:

a antenna layer having a primary slot formed entirely within the antenna layer, the primary slot not touching an edge of the antenna layer;

one or more secondary slots formed entirely within the antenna layer to form a slot antenna, the one or more secondary slots each having a perpendicular intersection crossing the primary slot, the secondary slots not touching an edge of the antenna layer; and one or more varactors coupled to one or more of the secondary slots and not connected across said perpendicular intersection, to tune the slot antenna to a desired frequency via selection of a capacitance of one or more of the varactors.

2. An apparatus as claimed in claim 1, wherein they varactors are the microelectromechanical system structures.

3. An apparatus as claimed in claim 1, wherein the slot antenna may be tuned to a channel of a cellular communication system via the varactors.

4. An apparatus as claimed in claim 1, wherein the slot antenna may be tuned to a channel of a wireless local area communication system via the varactors.

5. An apparatus as claimed in claim 1, wherein the one or more of the secondary slots is folded to provide an increased inductance for the secondary slot.

6. An apparatus as claimed in claim 1, wherein the slot antenna has a higher Q-factor based a higher Q-factor of the varactors.

7. An apparatus as claimed in claim 1, wherein an inductance of the secondary slots in combination with a capacitance of the varactors give the slot antenna a narrow band characteristic.

8. An apparatus as claimed in claim 1, wherein one or more of the varactors has a continuously selectable capacitance value.

9. An apparatus as claimed in claim 1, wherein one or more of the varactors has a discrete valued selectable capacitance.

10. An apparatus as claimed in claim 1, wherein one or more of the varactors comprises a network of selectable capacitors to provide a stepped variable capacitance value.

11. An apparatus, comprising:

a baseband processor to process basehand cellular telephone information;

a transceiver to couple to the basehand processor; and a slot antenna to couple to the transceiver, wherein the slot antenna comprises:

a antenna layer having a primary slot formed entirely within the antenna layer, the primary not touching an edge of the antenna layer, and one or more secondary slots formed entirely within the antenna layer to form a slot antenna, the one or more secondary slots each having a perpendicular intersection crossing the primary slot, the secondary slots not touching an edge of the antenna layer; and one or more varactors couple to one or more of the secondary slots and not connected across said perpendicular intersection to tune the slot antenna to a desired frequency via selection of a capacitance of one or more of the varactors.

12. An apparatus as claimed in claim 11, wherein the varactors are microelectromechanical system structures.

13. An apparatus as claimed in claim 11, wherein the slot antenna may be tuned to a channel of a cellular communication system via the varactors.

14. An apparatus as claimed in claim 11, wherein the slot antenna may be tuned to a channel of a wireless local area communication system via the varactors.

15. An apparatus as claimed in claim 11, wherein the one or more of the secondary slots is folded to provide an increased inductance for the secondary slot.

16. An apparatus as claimed in claim 11, wherein the slot antenna has a higher Q-factor based a higher Q-factor of the varactors.

17. An apparatus as claimed in claim 11, wherein an inductance of the secondary slots in combination with a capacitance of the varactors give the slot antenna a narrow band characteristic.

18. An apparatus as claimed in claim 11, wherein one or more of the varactors has a continuously selectable capacitance value.

19. An apparatus as claimed in claim 11, wherein one or more of the varactors has a discrete valued selectable capacitance.

20. An apparatus as claimed in claim 11, wherein one or more of the varactors comprises a network of selectable capacitors to provide a stepped variable capacitance value.

* * * * *